US006227635B1

(12) United States Patent
Teppo et al.

(10) Patent No.: US 6,227,635 B1
(45) Date of Patent: May 8, 2001

(54) STORAGE CABINET WITH HANDLE OPERATED DOOR

(75) Inventors: David S. Teppo, East Grand Rapids; Harold Halvorson, Jr., Grand Rapids, both of MI (US)

(73) Assignee: Steelcase Developments Inc., Grand Rapids, MI (US)

( * ) Notice: Subject to any disclaimer, the term of this patent is extended or adjusted under 35 U.S.C. 154(b) by 0 days.

(21) Appl. No.: 09/292,247

(22) Filed: Apr. 15, 1999

(51) Int. Cl.[7] ..... A47B 88/00

(52) U.S. Cl. ..... 312/328; 312/319.4; 312/245; 49/40

(58) Field of Search ..... 312/326, 327, 312/328, 319.1, 319.4, 245, 246, 319.2, 319.9, 325, 329, 271, 276; 49/40, 41, 203

(56) References Cited

U.S. PATENT DOCUMENTS

| | | | | |
|---|---|---|---|---|
| 180,605 | * | 8/1876 | Lee et al. | 49/40 |
| 463,150 | * | 11/1891 | Graves | 312/319.4 X |
| 1,213,141 | * | 1/1917 | Ask | 312/319.1 X |
| 1,682,093 | * | 8/1928 | Redman | 49/40 |
| 2,188,708 | * | 1/1940 | Davis | 312/319.2 X |
| 2,414,929 | * | 1/1947 | Civkin | 49/40 |
| 2,481,119 | * | 9/1949 | Jordan | 312/319.9 X |
| 2,728,625 | * | 12/1955 | Blahnik | 312/324 |
| 2,905,518 | * | 9/1959 | Doesken | 49/40 |
| 3,899,228 | | 8/1975 | Schreiber . | |
| 4,035,954 | | 7/1977 | Hoff . | |
| 4,798,425 | | 1/1989 | Armstrong et al. . | |
| 5,172,969 | | 12/1992 | Reuter et al. . | |
| 5,193,726 | | 3/1993 | Humphrey . | |
| 5,193,892 | | 3/1993 | Swindell . | |
| 5,257,638 | * | 11/1993 | Alvemarker | 312/328 X |
| 5,409,308 | | 4/1995 | Reuter et al. . | |
| 5,445,452 | | 8/1995 | Kauffman et al. . | |
| 5,456,529 | | 10/1995 | Cheung . | |
| 5,765,315 | | 6/1998 | Nagamitsu et al. . | |
| 5,765,390 | | 6/1998 | Johnson et al. . | |
| 5,845,980 | | 12/1998 | Fricano et al. . | |

FOREIGN PATENT DOCUMENTS

| | | | | |
|---|---|---|---|---|
| 430783 | * | 8/1967 | (CH) | 49/40 |
| 2309698 | * | 11/1976 | (FR) | 49/41 |
| 0302737 | * | 12/1936 | (IT) | 312/319.4 |

* cited by examiner

*Primary Examiner*—Peter M. Cuomo
*Assistant Examiner*—Hanh V. Tran
(74) *Attorney, Agent, or Firm*—Price, Heneveld, Cooper, DeWitt & Litton

(57) ABSTRACT

A storage apparatus includes a storage unit defining a front opening, and a door configured to cover the front opening. The door is operably attached to the storage unit for movement between opened, intermediate, and closed positions. The storage apparatus further includes a handle that is isolated from the door but operably connected to the door for selectively manually moving the door between the opened, intermediate, and closed positions. The handle is conveniently located at a front center of the storage unit, under a bottom thereof, such that the handle can be easily grasped and operated by a seated person, such as a wheelchair-bound person.

33 Claims, 4 Drawing Sheets

STORAGE CABINET WITH HANDLE OPERATED DOOR

BACKGROUND OF THE INVENTION

The present invention relates to a storage apparatus and, in particular, to an elevated storage apparatus that includes a handle operated door.

Storage cabinets are used in wide variety of applications to store numerous items, particularly above desk and work areas, and have been adapted to be used in conjunction with permanent structural walls, as well as portable reconfigurable partitions. These storage cabinets typically include a door attached to a box-like bin and are suspended above the desk or work area by way of structural supports extending from the desk or by mounting the overhead bin directly to the permanent structural wall or the collapsible partition. The main idea is the provision of an area to store articles.

The door of the storage bin is typically operated between an opened and closed position by manually grasping the door directly or by a pull attached to the door. The height of these overhead storage cabinets above the work or desk area typically require the operator to be in a standing position in order to comfortably reach the door. Such operation is inconvenient and cumbersome. Further, in many of the configurations currently used, it is physically impossible for a wheelchair-bound person to operate the door. In addition, many storage bins include doors that operate with a "guillotine-like" movement and may slam closed if released before they have been moved to their fully opened or closed position.

Accordingly, an apparatus solving the aforementioned problems and having the aforementioned advantages is desired.

SUMMARY OF THE INVENTION

One aspect of the present invention is to provide a storage apparatus that includes a storage unit defining a front opening, and a door configured to cover the opening. The door is operably attached to the storage unit for movement between opened, intermediate, and closed positions. The storage apparatus further includes a handle that is isolated from the door but is operably connected to door for selectively moving the door between the opened, intermediate, and closed positions. In one form, a cable connects the handle to the door, and comprises a flexible cable telescopingly received in a sleeve.

Another aspect of the present invention is to provide a storage apparatus including a storage unit defining a front opening, and a door configured to cover the front opening. The door is operably attached to the storage unit for movement between opened, intermediate, and closed positions. The storage apparatus further includes an actuator including a manually movable handle and at least one flexible member connected to the handle and to the door for moving the door between the opened, intermediate and closed positions as the handle is moved.

Yet another aspect of the present invention is to provide a method that includes a step of providing a storage unit defining a front opening and a door pivoted to the storage unit for covering the front opening, the door being movable between a plurality of door positions. The method further includes steps of providing a handle movable between a plurality of handle positions, linking the handle to the door so that the handle positions correspond to the door positions, and moving the handle between a plurality of handle positions to move the door between the plurality of door positions.

A principal object of the present invention is to provide a storage cabinet with a door that is easily operable between an opened, intermediate, and closed position by way of an actuator handle. The actuator can preferably be easily reached by a person in a seated position. In addition, the storage cabinet may be easily retrofitted to be supported on existing structural supports, from permanent structural walls, or freestanding partition systems. The storage cabinet can be constructed from numerous materials such as plastic, metal, wood, composites, and the like.

These and other advantages of the present invention will be further understood and appreciated by those skilled in the art by reference to the following written specification, claims, and appended drawings.

DETAILED DESCRIPTION OF PREFERRED EMBODIMENT

Figure 1:
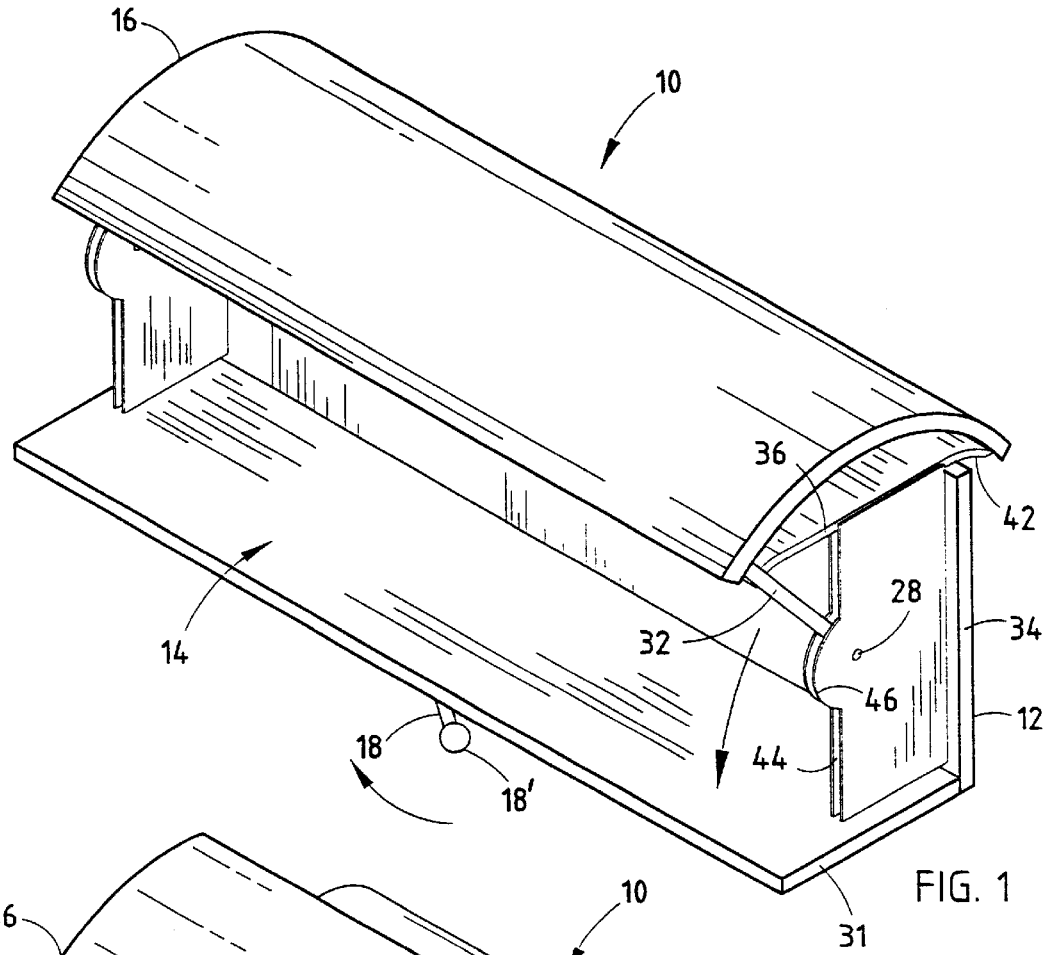
FIGS. 1–3 are perspective views of a storage apparatus embodying the present invention, with a door in opened, intermediate, and closed positions, respectively.

For purposes of description herein, the terms "upper," "lower," "right," "left," "rear," "front," "vertical," "horizontal," and derivatives thereof shall relate to the invention as oriented in FIG. 1. However, it should be understood that the invention may assume various alternative orientations and step sequences, except where expressly specified to the contrary. It should also be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 10 (FIG. 1) generally designates a storage apparatus embodying the present invention. In the illustrated example, storage apparatus 10 includes a storage unit or bin 12 defining a front opening 14, and a door 16 configured to cover front opening 14. Door 16 is operably attached to the bin 12 for movement between opened, intermediate (FIG. 2), and closed (FIG. 3) positions. A handle 18 is operably supported on bin 12 and linked to door 16 by a first cable 20 (FIGS. 4 and 5) and a second cable 22 for selectively manually moving door 16 between the opened, intermediate, and closed positions. Handle 18 includes a handle pivot 24 (FIG. 5), a handle pivot wheel 26, and a grip 18'. Door 16 includes a door pivot 28 (FIG. 4) and a door pivot wheel 30. First cable 20 and second cable 22 are flexible and extend around the pivot wheels 26 and 30 between door 16 and handle 18 and are arranged so that, when handle 18 is manually moved in first and second directions (FIG. 5), the first and second cables 20 and 22 pull door 16 between opened and closed positions, respectively. Handle 18 is conveniently located at a front center of bin 12, under a bottom wall 31 thereof, such that handle 18 can be easily grasped and operated by a seated person. Further, door 16 is pivoted to door pivot 28 by rigid arms 32 that are counter-weighted and/or spring biased to offset a weight of door 16, thus providing door 16 with a smooth and easy operation.

The illustrated storage unit or bin 12 (FIG. 1) includes bottom wall 31, a rear wall 34, top wall 36, and sidewalls 38. Bin 12 may be constructed of numerous materials, including but not limited to plastics, metals, wood, composites, and the like, depending upon the application. Bottom wall 31 and rear wall 34 may be provided with connection devices (not shown), such as hooks or brackets, for attaching bin 12 to structural supports (not shown) extending above the desk or work area, or to a permanent structural wall or a freestanding partition, depending on the application. Top wall 36 is provided with a downwardly extending, arcuately shaped front edge 40 (FIG. 2), and a downwardly extending, arcuately shaped rear edge 42. Each sidewall 38 is provided with a hollow interior 44 and a centrally located, forwardly extending, arcuately shaped extension 46, wherein door pivot 28 is centrally located.

The illustrated door 16 (FIG. 1) has an arcuate lateral cross-sectional shape substantially similar to the arcuate shape of front edge 40 and rear edge 42 of top wall 36. The similar arcuate shapes of front edge 40, rear edge 42, and door 16, allow door 16 to track more closely to top wall 36 when moved between the opened and closed positions, thereby allowing a reduction of the overall space required by the storage apparatus 10. Door 16 is provided with two rigid arms 32 located at opposite ends thereof, each having a first end 48, a second end 50, and door pivot 28 located therebetween. First end 48 of each rigid arm 32 is fixedly attached to a lower portion of door 16. Door 16 is further provided with substantially circular door pivot wheels 30 that are fixedly attached to rigid arms 32 at door pivots 28 and pivotally attached within interior 44 of sidewalls 38 at door pivots 28. When door 16 is moved between the opened and closed positions, each door pivot wheel 30 rotates with each rigid arm 32. Each door pivot wheel 30 is located within interior 44 of each sidewall 38, such that each door pivot wheel 30 does not extend forwardly beyond each arcuate extension 46 and is not easily visible. An open side area 52 (FIG. 3) is defined between door 16 and sidewalls 38 when door 16 is in the closed position.

Figure 2:
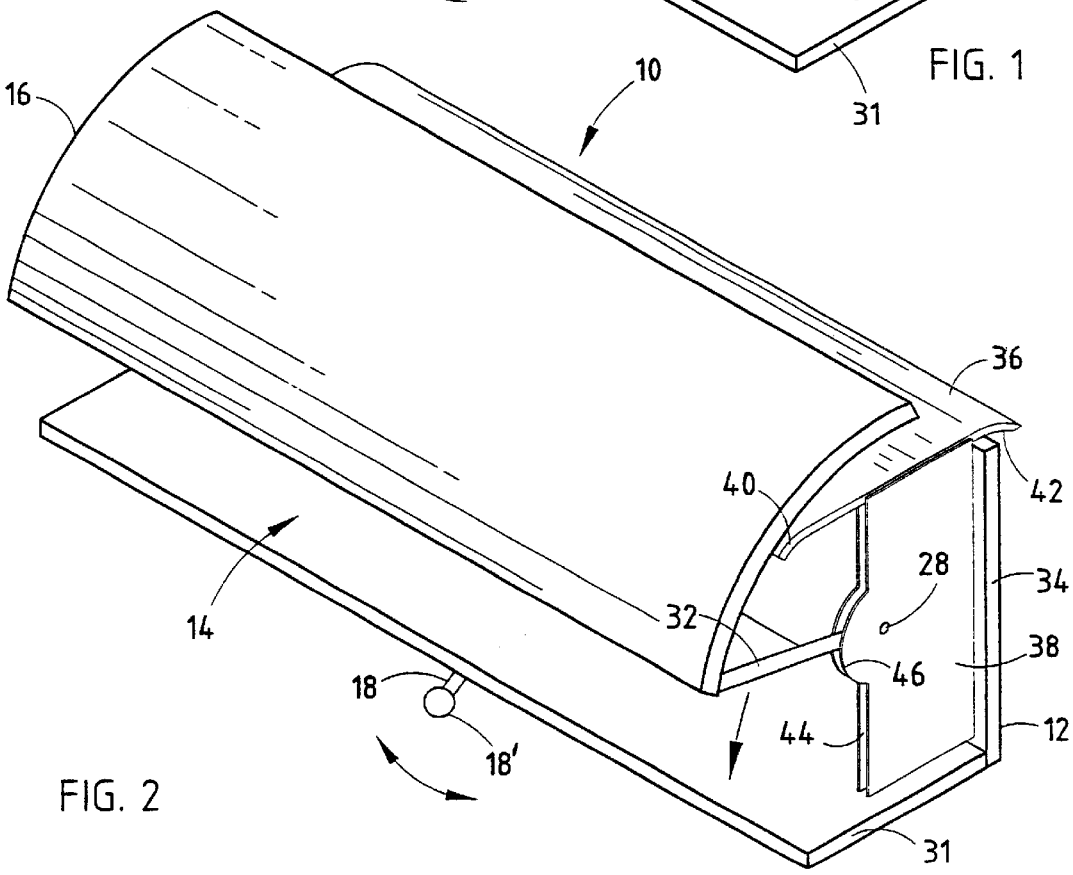
Figure 3:
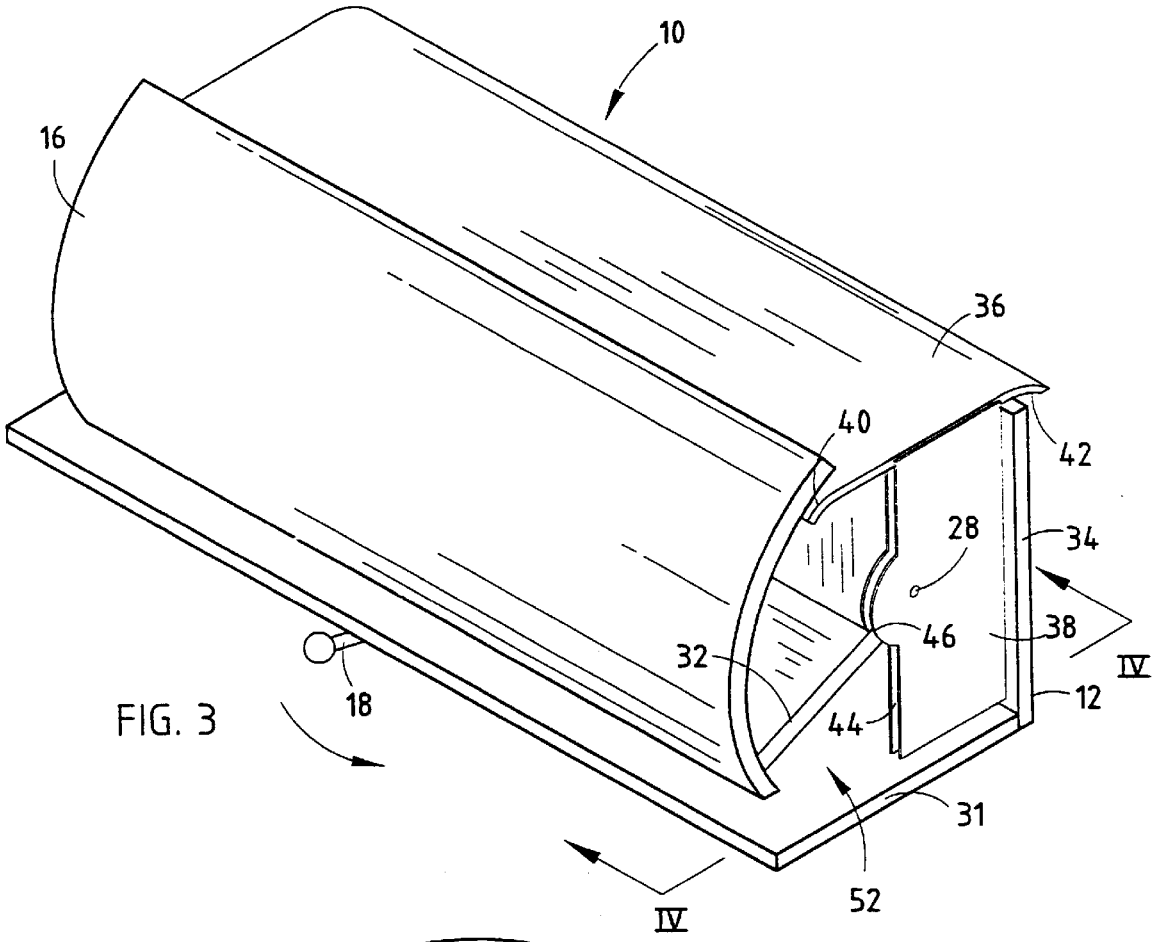
Figure 4:
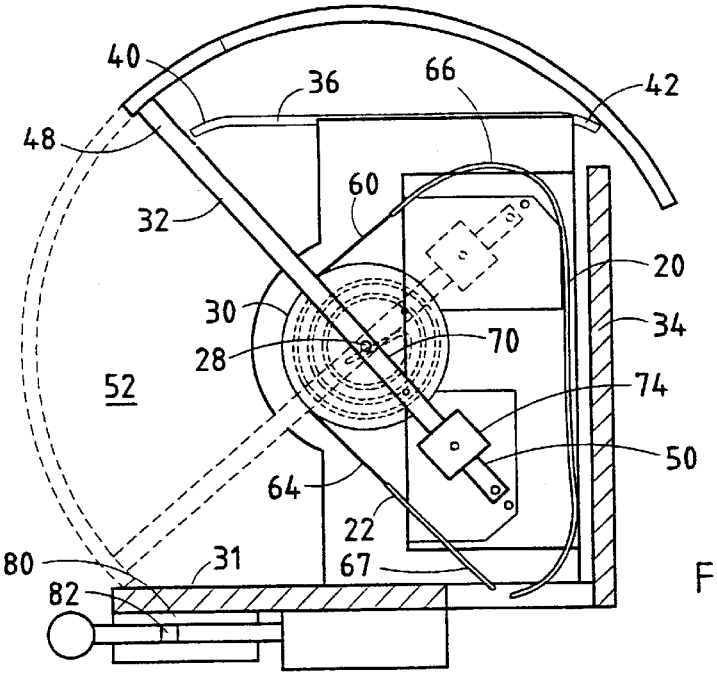
FIG. 4 is a cross-sectional, side elevational view of the storage apparatus taken along the line IV—IV in FIG. 3, the door being shown in an opened position in solid lines and in a closed position in dashed lines.
Figure 4A:
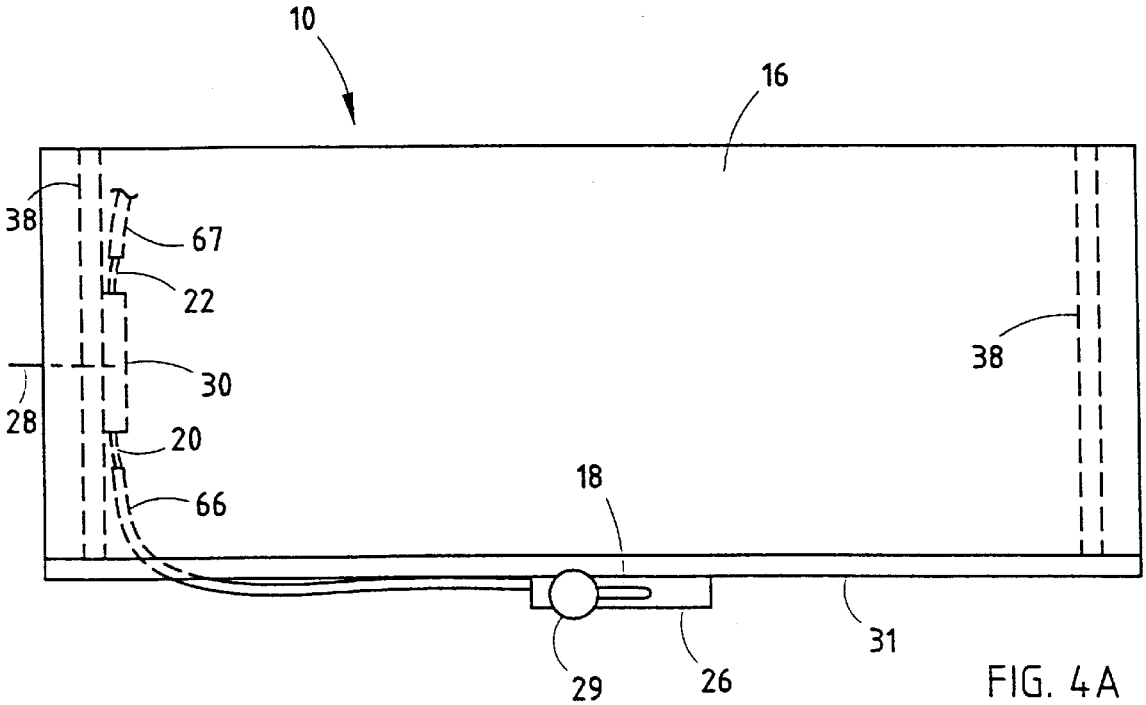
FIG. 4A is a front view of the storage apparatus shown in FIG. 1.
Figure 4B:
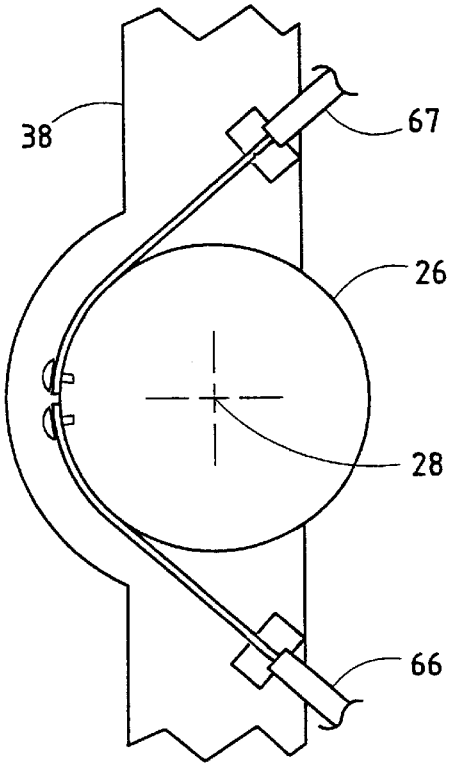
FIG. 4B is a side view of a side of the storage apparatus show in FIG. 1, including the door pivot and cables.
Figure 5:
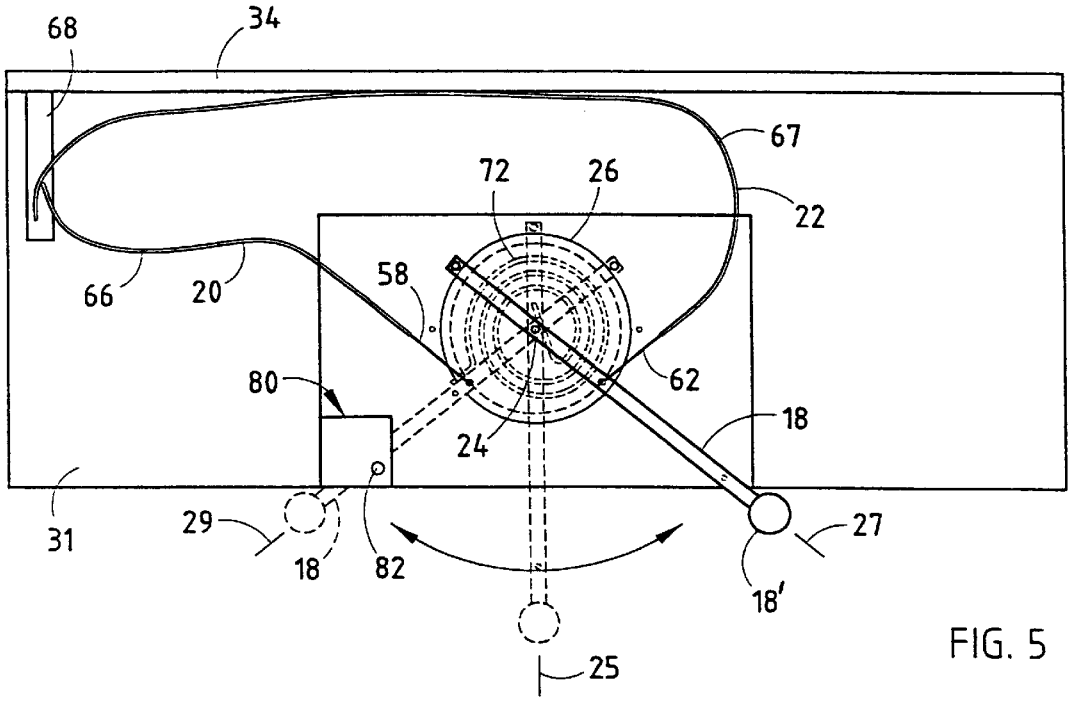
FIG. 5 is a bottom view of the storage apparatus, with a handle shown in an opened position in solid lines and in intermediate and closed positions in dashed lines.

Handle 18 (FIGS. 4 and 5) is operably supported on bin 12 and linked to door 16 by the first cable 20 and the second cable 22 for selectively manually moving door 16 between the opened, intermediate, and closed positions as shown in FIGS. 1, 2, and 3, respectively. As illustrated in FIG. 5, handle 18 includes handle pivot 24 and substantially circular handle pivot wheel 26. Handle pivot wheel 26 is fixedly attached to handle 18 about handle pivot 24 and pivotally attached beneath bottom wall 31 at handle pivot 24, such that handle 18 can be laterally pivoted between a first position 27, a second position 29, and a plurality of intermediate positions 25 therebetween. Handle 18 is provided a first end 54 and a second end 56. Handle 18 is pivotally attached beneath bottom wall 31, such that first end 54 of handle 18 extends outwardly beyond bottom wall 31, thereby allowing an operator to easily access and grasp handle 18.

First cable 20 (FIGS. 4, 4*a*, 4*b*, and 5) has a first end 58, a second end 60, and extends telescopingly through a cable sleeve 66. Second cable 22 also has a first end 62, a second end 64, and extends telescoping through a cable sleeve 67. Cable sleeves 66 and 67 fit snuggly about first and second cables 20 and 22, respectively, thereby providing enough natural friction to hold the door 16 in a stationary position when released, as discussed below. The illustrated cable 20 and sleeve 66 form a cable assembly where the cable 20 telescopingly slides through the sleeve 66 when the cable 20 is pulled. The cable 22 and sleeve 67 form a similar cable assembly. However, it is contemplated that the scope of the present invention includes arrangements using wire, string, tape, bands, strips, and even rigid mechanical links, with or without a sleeve.

In assembly, first end 58 of first cable 20 is fixedly attached and extends in a counterclockwise fashion about handle pivot wheel 26. First cable 20 extends from beneath bottom wall 31, up through an aperture 68 provided within bottom wall 31, and into interior 44 of one of the sidewalls 38. Second end 60 of first cable 20 is fixedly attached to and extends in a clockwise fashion about door pivot wheel 30. First end 62 of second cable 22 is fixedly attached to and extends in a clockwise fashion about handle pivot wheel 26. Second cable 22 extends from below bottom wall 31, up through aperture 68 of bottom wall 31, and into hollow interior 44 of one of the sidewalls 38. Second end 64 of second cable 22 is fixedly attached and extends in a counterclockwise fashion about door pivot wheel 30.

In operation, first cable 20 and second cable 22 are connected so that moving handle 18 between the first, intermediate, and second positions 27, 25, and 29 (FIG. 5), respectively, directly causes door 16 to move between the opened (FIG. 1), intermediate (FIG. 2), and closed (FIG. 3) positions. More specifically, when handle 18 is moved from the second position 29 to the first position 27, first cable 20 is pulled counter-clockwise about handle pivot wheel 26, thereby causing first cable 20 to pivot door pivot wheel 30 and rigid arm 32 counter-clockwise, which results in moving door 16 from the closed to the opened position. In reverse operation, when handle 18 is moved from the first position 27 to the second position 29, second cable 22 is forced in a clockwise direction about handle pivot wheel 26, thereby forcing second cable 22 to pull door pivot wheel 30 and rigid arm 32 in a clockwise position, which results in moving door 16 from the opened to the closed position.

Storage apparatus 10 is further provided with several components adapted to assist in the movement of door 16. Door 16 (FIG. 4) is further provided with helical door springs 70 located within door pivot wheels 30 that bias rigid arms 32, such that door 16 is biased towards an opened position. The torquing force provided by door springs 70 decrease the force required on handle 18 to move door 16 from the closed position towards the opened position, thereby providing a smooth counterbalanced door movement. Handle 18 is further provided with helical handle springs 72 located within handle pivot wheels 26 that bias handle 18 towards the first position 27 that corresponds with the opened position of door 16. The torquing force provided by handle springs 72 decrease the required force on handle 18 to move door 16 from the closed position towards the opened position. Rigid arms 32 are further provided with counterweights 74. Counterweights 74 are provided with set screws 75 threadably engaged therein and which contact rigid arms 32, such that counterweights 74 are slidably adjustable but securable to rigid arms 32. Adjusting counterweights 74 longitudinally along rigid arms 32 adjusts the moment arm between door pivot 28 and the position of the counterweights 74, thereby altering the resultant force acting on door 16 counteracting the weight of the door. This can be useful when different materials are used on the doors 16, thus causing a weight variance.

In operation, the frictional forces between cable sleeves 66 and 67, and first and second cables 20 and 22, respectively, overcome the gravitational forces acting on door 16 and hold door 16 in a selected intermediate position when handle 18 is accidentally or intentionally released by the operator. Such operational characteristics create a safer operating door by eliminating a guillotine-like motion of the door and the door moving uncontrollably towards the closed position when released. In addition, the summation of the torquing forces provided by door spring 70 and handle spring 72, the gravitational forces provided by counterweights 74, and the frictional forces between cable sleeves 66 and 67, and first and second cables 20 and 22, are adapted so as to allow door 16 to continue towards the opened or closed positions when handle 18 is released and door 16 is within approximately 2 inches of either the opened or closed positions, respectively. The summation of forces acting upon door 16 allows door 16 to remain in an intermediate selected position when handle 18 is released, and to continue towards the opened or closed position when the door is within approximately 2 inches of the opened or closed positions, respectively, thereby resulting in a smoother operating, safer door.

Storage apparatus 10 is further provided with a locking mechanism 80 (FIG. 5) attached beneath bottom wall 31 adjacent a position of the handle 18 when the door is in the closed position. Locking mechanism 80 is adapted to lockingly engage handle 18, such that handle 18 cannot be moved from its second position 29, thereby restricting physical access into bin 12 since the door 16 is held closed by the handle 18. Locking mechanism 80 is provided with a key lock 82 that is easily accessible by a person when in the seated position.

Figure 6:
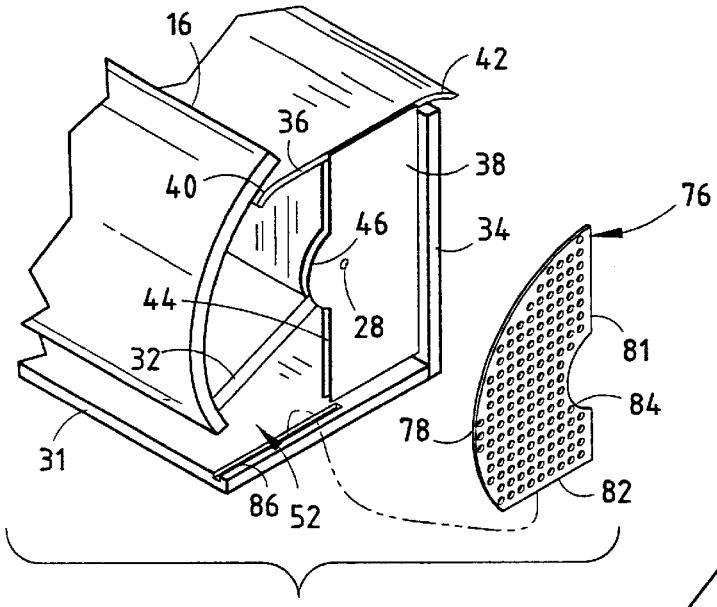
FIG. 6 is an exploded, fragmentary perspective view of the storage apparatus including a fixed half-sized side panel and a removable secondary side panel.

Bin 12 (FIG. 6) may be further adapted to include removable side baffles 76. Side baffles 76 are each provided with an arcuately shaped, forwardly facing edge 78, and substantially linear rear and bottom edges 81 and 82, respectively. The arcuate shape of forward edge 78 is substantially similar to the arcuate shape of door 16. Rear edge 81 is further provided with an arcuately-shaped notch 84. The arcuate shape of notch 84 is substantially similar to the arcuate shape of arcuate extension 46 of sidewalls 38. Bottom wall 31 is provided with laterally extending notches 86 adapted for positioning of bottom edge 82 of side baffles 76 therein. In assembly, side baffles 76 restrict physical access through open side areas 52 of bin 12.

Figure 7:
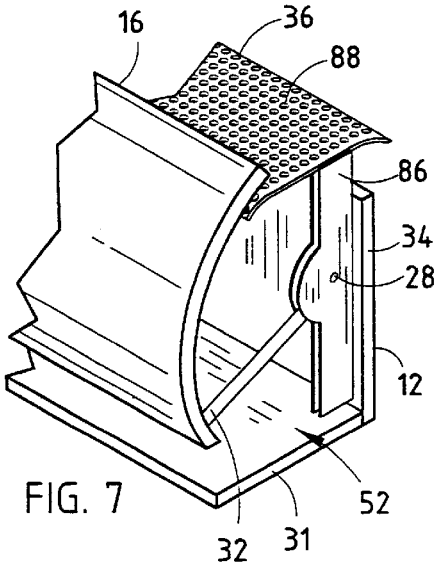
FIG. 7 is a fragmentary perspective view of a modified storage apparatus having an alternate side structural support and top.

The basic design of bin 12 and its associated elements allows components to be replaced, thus providing a more modernistic appearance. In an alternate embodiment (FIG. 7), sidewalls 38 are replaced with vertical structural supports 86, thereby allowing greater visual access into bin 12 through open side areas 52. In addition, top wall 36 may be provided with a plurality of equally spaced apertures 88, thereby providing bin 12 with a more modernistic appearance.

It is contemplated that the scope of the present invention includes bottom wall 31 that does not include one or both of top 36 or sides 38. In such case, the door 16 acts as a visual shield even though access is potentially possible over or around the door 16. Bottom wall 31 with doors 16 (and no sides nor top walls) can be made semi-secure where each storage unit 12 is part of a long horizontal run of storage unit 12 (i.e. where there is no side access) and/or where each storage unit 12 is vertically arranged so that bottom wall 31 of a higher mounted storage unit 12 acts as a top wall to a lower mounted storage unit 12 (with the door 16 moving under the higher mounted storage unit 12). It is contemplated that the present invention also includes constructing a removable, retrofittable storage unit 12 that can be set on a shelf. For example, the retrofittable storage unit 12 would include sides 38 attachable to a bottom wall 31, a rear wall 34 for stabilizing the sides 38 as a unit, a door 16 pivoted to the sides 38, and a handle assembly 18 attached to a bottom of bottom wall 31 and operably connected to door 16 by cables 20 and 22.

Storage apparatus 10 provides a greatly improved structure and method for operating the associated door 16 between the opened, intermediate, and closed positions, by providing handle 18 that is intuitive to operate and easily accessible by the operator while in the seated position. In addition, the configuration and construction of storage apparatus 10 results in a low cost, easy to build, and easy to fix overhead storage unit, and one that is easily adjustable to adapt to many existing bin supports, permanent structural walls, and collapsible partition systems.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A storage apparatus comprising:

a storage unit defining a front opening and including a bottom wall;

a door configured to cover the front opening and attached to the storage unit for movement between opened, intermediate and losed positions;

a handle isolated from the door and pivoted to the bottom wall; and a flexible cable operably connecting the handle to the door such that the handle may be used to selectively move the door.

2. The storage apparatus defined in claim 1, including a second flexible member connecting the handle to the door, the first flexible member being configured and connected to pull the door toward the opened position, and the second flexible member being configured and connected to pull the door toward the closed position.

3. The storage apparatus defined in claim 1, wherein the storage unit includes a bottom and sides forming a bin.

4. The storage apparatus defined in claim 3, wherein the handle is operably mounted on one of the sides or bottom of the bin and extends to a front of the bin proximate the front opening.

5. The storage apparatus defined in claim 1, including a bottom, and the handle is operably mounted to the bottom in a location where the handle can be easily reachable by a seated or wheelchair-bound person.

6. The storage apparatus defined in claim 5, wherein the handle includes a lever pivoted to the bottom at a handle pivot and includes a grip spaced forwardly from the handle pivot.

7. The storage apparatus defined in claim 1, including a spring connected to the handle for offsetting a weight of the door.

8. The storage apparatus defined in claim 1, including a lock configured to selectively disable the handle to thus lock the door in the closed position.

9. The storage apparatus defined in claim 1, including a link connecting the handle and the door that ties movement of the handle directly to movement of the door.

10. A storage apparatus comprising:

a storage unit defining a front opening;

a door configured to cover the front opening and attached to the storage unit for movement between opened, intermediate and closed positions;

a handle isolated from the door; and a flexible cable assembly including a flexible cable with a sleeve that telescopingly receives the cable, the cable operably connecting the handle to the door such that the handle may be used to selectively move the door.

11. The storage apparatus defined in claim 10, wherein the sleeve provides a natural friction on the cable that is sufficient to hold the door in the intermediate positions when the handle is released.

12. A storage apparatus comprising:

a storage unit defining a front opening;

a door configured to cover the front opening and attached to the storage unit for movement between opened, intermediate and closed positions;

a handle isolated from the door but operably connected to the door for selectively manually moving the door;

a first flexible member connecting the handle to the door wherein the first flexible member includes a cable and a flexible cable assembly with a sleeve that telescopingly receives the cable; and wherein the sleeve provides a natural friction on the cable that is sufficient to hold the door in the intermediate positions when the handle is released, and further wherein the natural friction on the cable is sufficiently low, and a weight and pivotal support of the door is such that the door naturally moves to the closed position when the door is within a predetermined distance of the closed position.

13. The storage apparatus defined in claim 12, wherein the natural friction on the cable is sufficiently low, and a weight and pivotal support of the door is located such that the door naturally moves to the opened position when the door is within a predetermined distance of the opened position.

14. A storage apparatus comprising:

a storage unit defining a front opening and including a bottom;

a door configured to cover the front opening and attached to the storage unit for movement between opened, intermediate and closed positions; and a handle isolated from the door but operably connected to the door for selectively manually moving the door, operably mounted to the bottom of the storage unit in a location where the handle can be easily reachable by a seated or wheelchair-bound persons and wherein the handle includes a handle wheel at a handle pivot, and including a flexible cable wrapped around the handle wheel with ends connected to the handle and to the door.

15. The storage apparatus defined in claim 14, including sides, and wherein the door includes rigid arms pivoted to the sides at door pivots.

16. The storage apparatus defined in claim 15, including a door wheel connected to one of the rigid arms at the door pivot, and wherein the cable wraps partially around the door wheel.

17. The storage apparatus defined in claim 16, including a counterweight attached to the rigid arms.

18. The storage apparatus defined in claim 16, including a spring connected to the rigid arms for offsetting a weight of the door.

19. The storage apparatus defined in claim 18, wherein the spring is located at and coils around the door pivot.

20. A storage apparatus comprising:

a storage unit defining a front opening and including a shelf;

a gravity actuated door configured to cover the front opening and operably attached to the storage unit for movement between opened, intermediate and closed positions, at least a portion of the door moving in a vertical direction with respect to the storage unit; and an actuator including a manually movable handle pivoted to the shelf and at least one flexible member connecting the handle to the door for moving the door between the opened, intermediate, and closed positions as the handle is moved.

21. The storage apparatus defined in claim 20, wherein the storage unit includes a bottom, and wherein the handle is operably attached to the bottom for movement.

22. The storage apparatus defined in claim 21, wherein the handle is pivoted to the bottom at a handle pivot.

23. The storage apparatus defined in claim 22, wherein the handle includes a lever pivoted to the bottom at the handle pivot and includes a handgrip spaced from the handle pivot.

24. The storage apparatus defined in claim 20, including an arm pivotally supporting the door on the storage unit at a door pivot, and including a spring connected to the arm for offsetting a weight of the door.

25. The storage apparatus defined in claim 20, wherein the handle is pivoted at a handle pivot and includes a handle wheel at the handle pivot, and wherein the flexible member is wrapped partially around the handle wheel.

26. The storage apparatus defined in claim 20, including a lock on the handle configured to selectively disable the handle to thus lock the door in the closed position.

27. A storage apparatus comprising:

a storage unit defining a front opening and including a bottom;

a door configured to cover the front opening and operably attached to the storage unit for movement between opened, intermediate and closed positions; and an actuator including a manually movable handle that includes a lever pivoted to the bottom of the storage at a handle pivot and a handgrip spaced apart from the handle pivot, and at least one flexible member connecting the handle to the door for moving the door between the opened, intermediate, and closed positions as the handle is moved, wherein the handle includes a handle wheel at the handle pivot, and wherein the flexible member is partially wrapped around the handle wheel, the flexible member having ends connected to the handle and to the door.

28. The storage apparatus defined in claim 27, including sides, and wherein the door includes rigid arms pivoted to the sides at door pivots.

29. The storage apparatus defined in claim 28, including a door wheel at the door pivot, and wherein the flexible member wraps around the door wheel.

30. A method comprising steps of:

providing a storage unit defining a front opening and a bottom that defines a front edge, and a door pivoted to the storage unit for covering the front opening, the door being moveable between a plurality of door positions;

providing a handle operably attached to the bottom of the storage unit and that is laterally moveable along the front edge of the bottom between a plurality of handle positions;

linking the handle to the door so that the handle positions correspond to the door positions; and moving the handle in a plane parallel to the bottom of the storage unit between a plurality of handle positions to move the door between the plurality of door positions.

31. The method defined in claim 30, wherein the handle is pivoted to the bottom.

32. The method defined in claim 31, wherein the step of linking the handle to the door includes attaching a flexible cable between the handle and the door.

33. The method defined in claim 32, wherein the step of linking includes attaching a second flexible member between the handle and the door, the first-mentioned and second flexible members being configured to pull the door toward opened and closed positions, respectively.

* * * * *

UNITED STATES PATENT AND TRADEMARK OFFICE

CERTIFICATE OF CORRECTION

PATENT NO. : 6,227,635 B1
DATED : May 8, 2001
INVENTOR(S) : David S. Teppo et al.

It is certified that error appears in the above-identified patent and that said Letters Patent is hereby corrected as shown below:

Column 1,
Line 42, before "door" insert -- the --.

Column 4,
Line 7, "telescoping" should be -- telescopingly --.
Line 8, "snuggly" should be -- snugly --.

Column 6, claim 1,
Line 39, "losed" should be -- closed --.

Column 7, claim 14,
Line 56, before "seated" delete "a".

Signed and Sealed this

Eighth Day of January, 2002

*Attest:*

*Attesting Officer*

JAMES E. ROGAN
*Director of the United States Patent and Trademark Office*